United States Patent [19]

Balembois

[11] Patent Number: 4,705,462

[45] Date of Patent: Nov. 10, 1987

[54] PROCESS AND DEVICE FOR IMPROVING WORKING OF LIQUID PUMPS

[75] Inventor: Claude Balembois, Rhode St. Genese, Belgium

[73] Assignee: Dorr-Oliver Incorporated, Stamford, Conn.

[21] Appl. No.: 795,017

[22] Filed: Nov. 4, 1985

[30] Foreign Application Priority Data

Apr. 11, 1985 [BE] Belgium ..... 0/214820

[51] Int. Cl.[4] ..... F04B 43/06

[52] U.S. Cl. ..... 417/395

[58] Field of Search ..... 417/395, 12, 392; 60/394

[56] References Cited

U.S. PATENT DOCUMENTS

| | | | |
|---|---|---|---|
| 2,673,525 | 3/1954 | Lucas | 417/395 X |
| 2,823,618 | 2/1958 | Wilson | 417/395 X |
| 3,227,314 | 1/1966 | Porter et al. | 417/395 X |
| 3,781,141 | 12/1973 | Schall | 417/395 |
| 3,814,548 | 6/1974 | Rupp | 417/395 |
| 3,816,034 | 6/1974 | Rosenquest, Jr. | 417/395 |
| 4,212,589 | 7/1980 | Bosio | 417/12 |
| 4,432,706 | 2/1984 | Gilbertson | 91/275 X |
| 4,530,645 | 7/1985 | Whatley | 91/275 X |

*Primary Examiner*—Leonard E. Smith

*Attorney, Agent, or Firm*—Burtsell J. Kearns

[57] ABSTRACT

A pump having a pump cavity divided into a first chamber and a second chamber by a movable member, said first chamber being adapted to be filled by liquid, with the movable member displaceable between a first extreme position for which said first chamber is essentially filled with said liquid and a second extreme position for which said first chamber is essentially emptied of said liquid; and means for detecting the position of the movable member and said actuating means actuate filling of said first compartment when the movable member is in said second position or the emptying of said first chamber when the movable member is in his said first position.

1 Claim, 3 Drawing Figures

PROCESS AND DEVICE FOR IMPROVING WORKING OF LIQUID PUMPS

BACKGROUND OF THE INVENTION

The present invention concerns essentially a process and device for improving working of liquid pumps. More precisely, the invention concerns a process and device for improving working of liquid pumps having a pump cavity in which a movable member is displaceable in the function of filling or emptying of said cavity with said liquid.

Certain of these pumps are designed to pump liquids or fluids which can have different densities or viscosities. The filling of the pump cavity with the liquid is usually performed by gravity by disposing the container of liquid at an upper level with respect to the level of the pump. The emptying of the pump cavity is then performed by injecting air under pressure or another compressible fluid against the movable member so as to displace it appropriately for emptying the pump.

In these known pumps, there is a problem of performing a full filling or a full emptying of the liquid irrespective of the nature of the liquid and of the time notably for filling the pump with the aid of gravity. Further, the time needed for emptying the pump can vary widely.

At the present time, these pumps are provided with timers which do not readily adapt to the working conditions of filling and/or emptying the liquid since it is not possible to know precisely the time for filling or emptying the pump. Therefore, there is a great risk to perform an emptying before having fully filled the pump and/or a filling before having fully emptied the pump.

The main object of the invention is therefore to solve the technical problems linked to the working of the pump to allow working only when it has been fully filled or fully emptied.

Another main object of the invention is to provide a solution allowing adjustment of the pump rate in wide limits.

Thus, according to a first object, the present invention provides a system for improving working of liquid pumps having a pump cavity in which a movable member is displaceable in function of filling or emptying of said cavity with said liquid, said liquid being preferably fed by gravity to the pump cavity, wherein the improvement comprises detecting the displacement of the movable member and actuating filling or emptying of said pump cavity in function of the displacement of said movable member.

According to a preferred embodiment, the pump has a pump cavity divided into a first chamber and a second chamber by said movable member, said first chamber being foreseen to be filled by said liquid, said movable member is displaceable between a first extreme position for which said first chamber is essentially filled with said liquid and a second extreme position for which said first chamber is essentially emptied of said liquid; said detecting of displacement of the movable member involves detecting the position of said movable member and said actuating comprises filling said first chamber when the movable member is in said second position or emptying said first chamber when the movable member is in said first position.

According to another embodiment of the invention the system further comprises setting a predetermined time of cycle for emptying and filling the pump; and causing emptying the pump when said time of cycle has lapsed; thereby obtaining a pump rate settable at will.

According to a second aspect, the invention also provides a device for improving working of liquid pumps having a pump cavity in which a movable member is displaceable in function of filling or emptying said pump cavity with said liquid, comrising detecting means for detecting the displacement of the movable member and actuating means for actuating filling or emptying of said pump cavity in function of the displacement of said movable member.

According to a specific feature of the invention device, the pump has a pump cavity divided into a first chamber and a second chamber by said movable member, said first chamber being foreseen to be filled by said liquid, said movable member is displaceable between a first extreme position for which said first chamber is essentially filled with said liquid and a second extreme position for which said first chamber is essentially emptied of said liquid; said detecting means detect the position of said movable member and said actuating means actuate filling of said first compartment when the movable member is in said second position or the emptying of said first chamber when the movable member is in the said first position.

According to another advantageous feature of the invention device, said device comprises a timer which can set a predetermined time of cycle for emptying and filling the cavity; and said timer actuates said actuating means for emptying the pump cavity when this predetermined time of cycle has lapsed.

SUMMARY OF THE INVENTION

According to a preferred embodiment, the sensing of the position of the movable member is performed with the aid of a sensor emitting a signal to said actuating means.

On the other hand, according to a preferred embodiment, the invention device comprises means for delivering a fluid under pressure, preferably air, to said second chamber via a fluid feeding duct, said feeding duct being provided with a valve for closing or opening said duct, said actuating means actuating said valve.

According to another preferred embodiment, said device comprises an intermediary member indicating at an appropriate distance the position of the movable element, said sensing means sensing the position of the movable element, said sensing means sensing the position of said intermediary member. Said intermediary member can be a rod, the lower end of which is fixed to said movable member and the free end of which is sensed by said sensing means, preferably constituted by sensors.

Preferably, the rod is displaceable inside a transparent tube so that the movement thereof is easily seen by an operator.

Finally, the pump can be a spring assisted pump.

Thus, it can be easily understood that with the invention it is achieved, unexpectedly and unobviously for one skilled in the art, the previously set forth technical advantages including the filling or the emptying of the pump only when the pump has been previously fully emptied or filled and further the setting of the pump rate in wide limits.

DESCRIPTION OF THE DRAWINGS

Other features, advantages and purposes of the invention will appear clearly from the following description of the invention in reference with the appended drawings in which.

DETAILED DESCRIPTION

Figure 1:
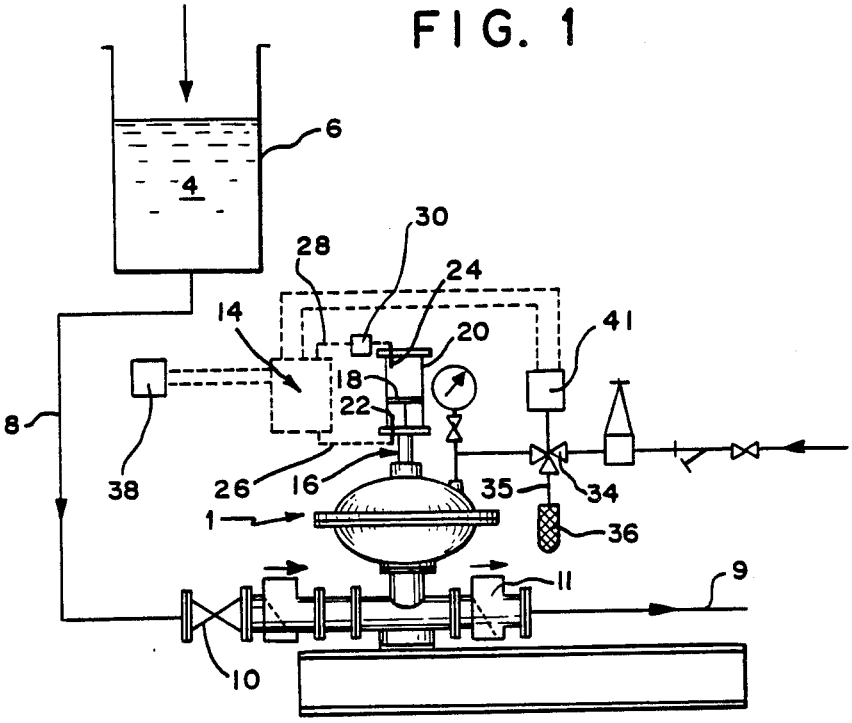
FIG. 1 shows the best embodiment of the invention liquid pump incorporated in a circuit for delivering a liquid.
Figure 3:
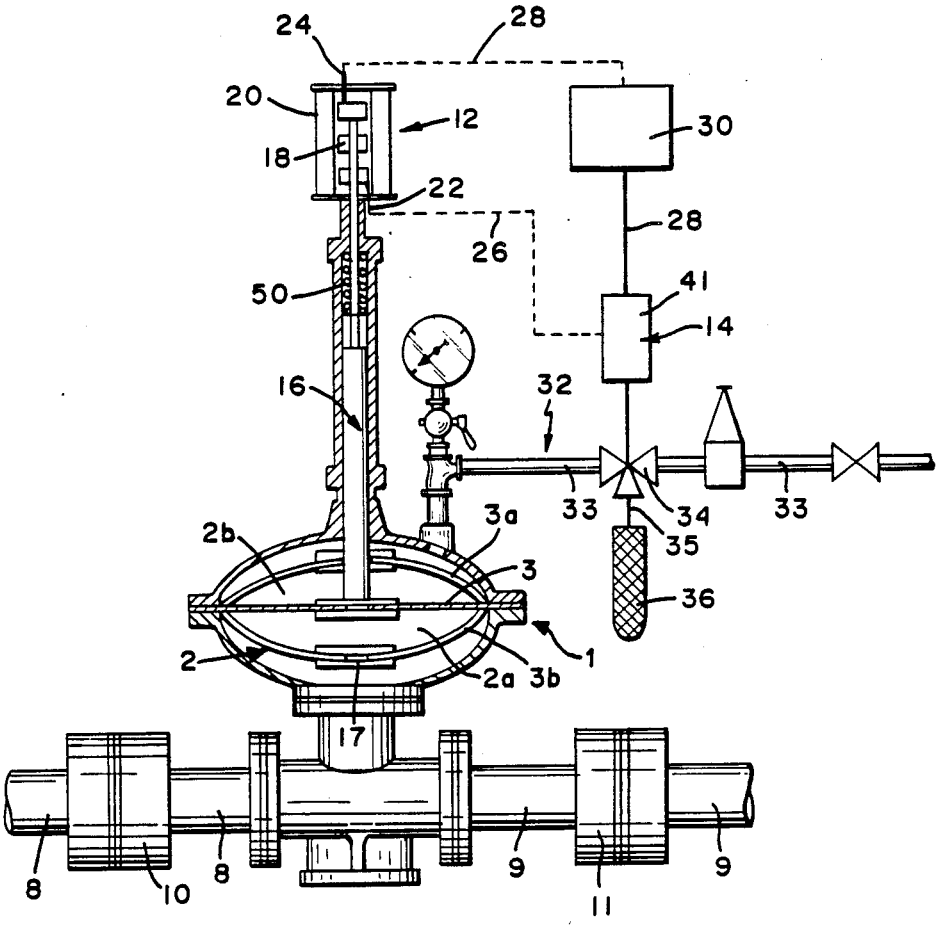
FIG. 3 shows an enlarged view of same embodiment of an invention liquid pump with a vertical cross-section at the level of the pump cavity with minor modifications.

In reference with FIGS. 1 and 3, it is shown the best embodiment of an invention device for improving working of liquid pumps. This liquid pump is referenced with the general reerence number 1 and has a pump cavity 2 (FIG. 3) in which a movable member or flexible pump diaphragm 3 is displaceable in function of filling or emptying said pump cavity 2 with liquid 4 preferably stored in a liquid storage tank 6 (FIG. 1). This liquid storage tank 6 is preferably located at a level higher than the level of the pump so as to feed said liquid with the aid of gravity. A duct 8 is connecting the liquid storage tank 6 to the pump 1 via a non-return valve 10.

According to the invention, said device comprises sensing means referenced with a general reference number 12 for detecting the displacement of the movable diaphragm member 3 and actuating means 14 for actuating filling or emptying of said pump cavity 2 in function of the displacement of the movable member 3.

According to a preferred embodiment, said device further comprises providing an intermediary member 16 linked in displacement to said movable member 3 and indicating at an appropriate distance, namely here at the free end 18 thereof, the position of the movable element 3. Accordingly, said sensing means 12 are sensing the position of the intermediary member 16, namely here the position of the free end thereof 18. To this effect, the intermediary member is preferably constituted by a rod having one end 17 fixed to said movable element 3, in practice constituted by a membrane, whereas the free end thereof 18 is slidably located within an hollow tube 20 preferably transparent so as to be easily seen from any operator. The original position of the free end 18 of the rod constituting the intermediary member 16 is such that the extreme positions of the movable member 3 are within the hollow tube 20 so as to be clearly seen by any operator.

Further, the pump cavity 2 is divided in fact into a first chamber 2*a* and a second chamber 2*b* by said movable member 3. Said first chamber 2*a* is foreseen to be filled by said liquid as clearly understandable from FIGS. 1 and 3. Movable member 3 is displaceable between a first extreme position 3*a* for which said first chamber 2*a* is essentially filled with said liquid and a second extreme position 3*b* for which said first chamber 2*a* is essentially emptied of said liquid.

Detecting means 12 comprises a bottom sensor 22 for detecting one extreme position of the intermediary member 16, i.e. here the extreme position 3*b* for which the first chamber 2*a* is fully emptied; and a top sensor 24 for detecting another one extreme position of the intermediary member 16 and thus of the movable member, i.e. the extreme position 3*a* for which the first chamber 2*a* is fully filled.

Bottom and top sensors 22, 24 emit a signal to said actuating means 14 as shown by the presence of electrical conduits 26, 28. On electrical conduit 28, i.e. between the top sensor 24 and the actuating means 14, a timer 30 is preferably interposed to permit actuation of actuating means 14 only when a predetermined period of time of cycle has lapsed since it will be understood that when the top sensor 24 detects the presence of the free end 18 of the intermediary members 16, the first chamber 2*a* will be fully filled, after having been previously emptied.

Further, the pump 1 also comprises means 32 for delivering a fluid under pressure, preferably air, to said second chamber 2*b* of the pump 1 by a fluid feeding duct 33, said feeding duct 33 being provided with a valve 34 for putting this duct 33 in communication either with said fluid under pressure or with the atmosphere by a derivation 35 provided with an air filter 36. This valve is preferably an electrically controlled valve such as an electromagnetic valve, with an electromagnet 41.

Figure 2:
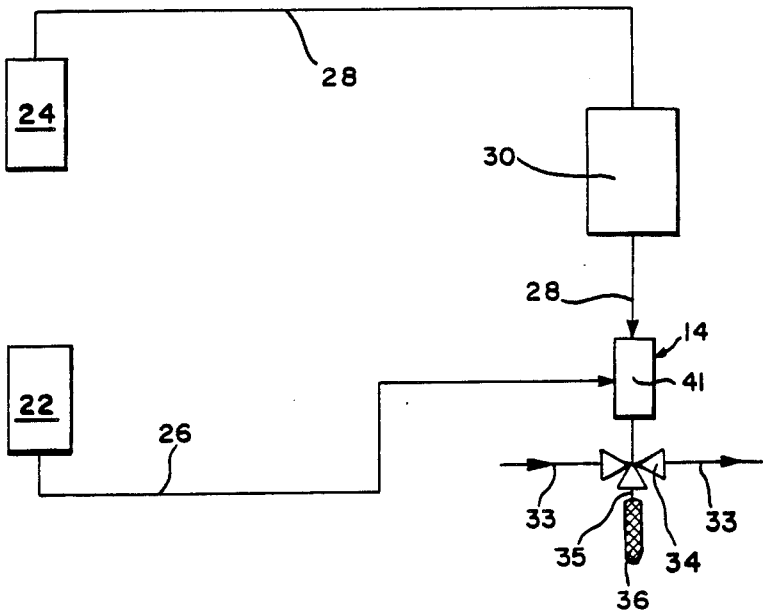
FIG. 2 shows in more detail the sensors with timer used in the embodiment of FIG. 1.

Accordingly, when the sensor 22 or 24, which can be for instance a proximity sensing sensor, is sensing the presence at the proximity thereof of the free end 18 of the intermediary pump actuating rod member 16, said sensor emits a signal to actuating means 14 which can include an electric center for closing an electrical circuit from an electrical current source 38 to for instance electrical means actuating the valve 34. Accordingly, the electrical center, when present, constitutes in fact a power relay. FIGS. 2 and 3 show a direct actuation of the valve by the sensors and in this case the actuating means 14 essentially comprise the electromagnet 41.

According to another embodiment of the present invention, pump 1 is a spring assisted pump and therefore comprises a spring 50 which is in a non-stressed condition in the off position of the movable member 3. This spring 50 is under a compressed state in the 3*a* position of the movable member 3 and is under an extensed condition in the position 3*b* of the movable member 3.

The fluid under pressure, preferably compressed air, is fed to duct 33 either by the aid of a compressor (not shown) or with the aid of a bottle of compressed air.

Further, the pump is delivering liquid into an outlet duct 9 provided with a non-return valve 11 of the same type as the non-return valve 10 of duct 8 from the liquid storage tank 6.

The operation of pump 1 is as follows:

The position of the movable member 3 being at first for instance the extreme position 3*b* for which the first chamber 2*a* is fully emptied, the free end 18 of the intermediary member 16 is in close contact to bottom sensor 22. Bottom sensor 22 therefor sends a signal to actuating means 14 to close valve 34 with respect to the source of compressed air and to put it in communication with the atmosphere so as to release the pressure into second chamber 2*b*.

As a result, liquid is fed by gravity from liquid storage tank 6 by a natural opening of non-return valve 10 and is filling first compartment 2*a* until reaching the extreme position 3*a* for which the free end 18 of the intermediary member 16 is in close contact to top sensor 24.

At this top position, top sensor 24 sends a signal to actuating means 14 to close the valve with respect to the atmosphere and to open it, i.e. to put it in communication, with respect to the source of compressed air.

However, in the preferred embodiment of the presence of a timer 30, this last operation is only allowed when the predetermined period of time set on the timer has lapsed, so as to adapt the pump rate to a predetermined liquid rate.

Therefore, once this predetermined period of time has lapsed, the timer 30 delivers an electrical signal to the actuating means 14 and fluid under pressure is fed to the second chamber **2*b*, thereby beginning the emptying of first chamber 2*a* and simultaneously closing non-return valve 10 and opening non-return valve 11**.

When the movable member 3 is again reaching the bottom extreme position **3*b*, bottom sensor 22** is actuated and a further sequence begins.

Further, the free end 18 of the intermediary member 16 being seeable from the outside by being displaceable within a transparent hollow tube 20, any operator can see the actual position of this free end 18 and therefore of the movable member 3 within the pump. Accordingly, the operator can determine the actual time needed to perform a full filling of the pump by gravity. This is very important when the liquid to be pumped is viscous or is changing of viscosity and of density in the time.

Of course, preferably, the level in the liquid storage tank 6 is maintained constant to have a constant liquid pressure for feeding the pump.

It can be understood that all the positive technical results previously set forth are achieved, as well as the invention process previously emphasized.

Of course, should the sensors 22, 24 be able to deliver an electric signal sufficient to directly actuate the electromagnet of valve 34, then it can be avoided the presence of a current source but usually, the presence of a current source is required or at least of a power relay.

Accordingly, a number of modifications of the invention are possible without departing from the scope of the invention.

What is claimed is:

1. A pumping system for a spring assisted diaphragm pump having a pump housing, a diaphragm dividing the housing into a pumping chamber having means for pump discharge and for pump intake, and a pump actuating chamber having an opening substantially concentric with the diaphragm, said actuating chamber adapted to receive a fluid pressure medium acting upon one side of the diaphragm to produce the pumping stroke and means for predetermining the distance of the pumping stroke comprising, (a) an actuating rod extending from said diaphragm through said pump actuating chamber opening in said pump housing with a major portion of the length of said rod outwardly exposed of the pump housing, (b) said pump actuating chamber adapted to be filled by liquid at the other side of said diaphragm with said actuating rod displaceable between a first extreme position in a first direction within said pump housing when said actuating chamber is filled with said liquid and to a second extreme position in an opposite direction when said actuating chamber is emptied of said liquid, (c) a casing surrounding the exposed length of the rod connected to said pump housing with an upper end portion of said actuating rod extending through the upper end of said casing, (d) stroke detecting means located at said exposed portion of said actuating rod including sensing means comprising a bottom sensor for detecting said first extreme position of said actuating rod and a top sensor for detecting the other extreme position of said actuating rod, (e) actuating means interconnected with said sensing means for receiving a signal for said sensing means controlling movement of said actuating rod and interconnected pump diaphragm, and (f) a timer connected to the sensing means adapted to set a predetermined cycle time for authorizing operation of said actuating means for the emptying and filling said pump actuating chamber, (g) said actuating means comprising an electromagnetic device operable to open and close a valve member to a source of compressed air to said pump actuating chamber.

* * * * *